US005467711A

United States Patent [19]

Maejima

[11] Patent Number: 5,467,711

[45] Date of Patent: Nov. 21, 1995

[54] PLATE EXCHANGE APPARATUS FOR PRINTING PRESS

[75] Inventor: Kazuhiro Maejima, Ibaraki, Japan

[73] Assignee: Komori Corporation, Tokyo, Japan

[21] Appl. No.: 267,841

[22] Filed: Jun. 28, 1994

Related U.S. Application Data

[63] Continuation of Ser. No. 1,338, Jan. 7, 1993, abandoned.

[30] Foreign Application Priority Data

Jan. 8, 1992 [JP] Japan ..... 4-003591 U

[51] Int. Cl.[6] ..... B41F 27/06; B41F 27/12

[52] U.S. Cl. ..... 101/216; 101/477

[58] Field of Search ..... 101/216, 415.1, 101/486, 132.5, 141, 142, 143, 144, 409–411, 136, 137, 477

[56] References Cited

U.S. PATENT DOCUMENTS 5,111,744 5/1992 Waeland ..... 101/216

FOREIGN PATENT DOCUMENTS 431575 6/1991 European Pat. Off. .
0431575 6/1991 European Pat. Off. .
62-169646 7/1987 Japan .
169646 1/1988 Japan .
63-191636 8/1988 Japan .

OTHER PUBLICATIONS

Patent Abstracts of Japan vol. 12, No. 466 (M–772) Dec. 7, 1988.
Patent Abstracts of Japan vol. 12, No. 4 (M–657) (2851) Jan. 8, 1988.

*Primary Examiner*—J. Reed Fisher
*Attorney, Agent, or Firm*—Blakely, Sokoloff, Taylor & Zafman

[57] ABSTRACT

A plate exchange apparatus for a printing press includes a plate guide member and operating members. The plate guide member guides one end of a plate into plate gripper surfaces of a leading-side plate lockup device when the one end of the plate opposes the plate gripper surfaces of the leading-side plate lockup device, and inserts the plate into plate gripper surfaces of a trailing-side plate lockup device under pressure when the other end of the plate wound around a plate cylinder opposes the plate gripper surfaces of the trailing-side plate lockup device. The operating members press the plate guide member against a circumferential surface of the plate cylinder until the other end of the plate is inserted under pressure after the one end of the plate is gripped.

4 Claims, 4 Drawing Sheets

PLATE EXCHANGE APPARATUS FOR PRINTING PRESS

This is a continuation of application Ser. No. 08/001,338 filed on Jan. 7, 1993, now abandoned.

BACKGROUND OF THE INVENTION

The present invention relates to a plate exchange apparatus for a printing press, for removing a plate used from a plate cylinder and mounting a plate to be used on the plate cylinder.

In a variety of printing presses, leading- and trailing-side plate lockup devices each consisting of a plate lockup table extending in an axial direction of the plate cylinder and gripper plates pivotally supported on the plate lockup table are arranged in a circumferential gap of a plate cylinder. When a plate is to be mounted on the plate cylinder, the plate, one end of which is gripped by the plate lockup table and the gripper plates of the leading-side plate lockup device, is wound around the circumferential surface of the plate cylinder upon almost one revolution of the plate cylinder. The other end of the plate is gripped by the plate lockup table and the gripper plates of the trailing-side plate lockup device and is mounted on the plate cylinder. When the plate is to be removed from the plate cylinder, the plate is released from the trailing-side plate lockup device and is rewound from the circumferential surface of the plate cylinder upon almost one revolution of the plate cylinder. The plate is finally released from the leading-side plate lockup device. The removed plate is removed outside the printing press.

When the specifications of printed matters are changed, an old plate used is exchanged with a new plate, as described above. However, this manual plate exchange operation requires much labor, is time-consuming, and is dangerous. In recent years, a full-automatic plate exchange apparatus for mechanically removing an old plate and mounting a new plate or a semi-automatic plate exchange apparatus for manually inserting a plate into gripper surfaces of a plate lockup device have been developed.

Of these plate exchange apparatuses, the semi-automatic plate exchange apparatus comprises a pair of track tables supported by an upper portion of a printing unit and suspending along right and left frames, right and left roller arms driven to be swingable and vertically movable along the track tables, and a plate press roller rotatably supported between free end portions of the roller arms, as disclosed in Japanese Patent Laid-Open No. 63-191636. The plate press roller is brought into contact with or separated from the circumferential surface of the plate cylinder upon swingable movement of the roller arms. A fixed plate guide is arranged at upper end portions of the track tables.

With the above structure, when a plate is to be mounted on a plate cylinder, the roller arms are moved downward to separate the plate press roller from the circumferential surface of the plate cylinder. The plate guided in contact with the plate guide is manually held to grip the plate with a leading-side plate lockup device, and the roller arms are swung to bring the plate press roller into contact with the plate. In this state, the plate cylinder is rotated by almost one revolution to wind the plate on the circumferential surface of the plate cylinder. At the same time, the roller arms are moved upward to stop rotation of the plate cylinder at a position where the plate press roller opposes a trailing-side plate lockup device. The trailing end of the plate is gripped by the trailing-side plate lockup device, thereby completely mounting the plate. That is, the plate press roller is operated during winding of the plate around the plate cylinder and gripping of the trailing end of the plate. The plate press roller is not operated during gripping of the plate on the leading side.

In this conventional plate exchange apparatus, however, when the plate is to be inserted into the gripper surfaces of the leading-side plate lockup device, the plate must be manually held as in the conventional case. It is not easy to insert the plate into a narrow opening. If the plate thickness is small, it is difficult for a single operator to hold the entire thin plate and perform this operation, thus disabling reduction in labor. In addition, when the trailing end of the plate is to be inserted into the gripper surfaces of the trailing-side plate lockup device under pressure, the plate may be undesirably bent. When the radial position of the plate press roller with respect to the plate cylinder is inappropriate upon bringing the plate press roller into contact with the circumferential surface of the plate press roller, the plate is gripped while an insertion amount of the tailing end of the plate into the gripper surfaces is insufficiently small. Alternatively, the trailing end of the plate is excessively pressed. In either case, the printing position is deviated from a proper position, thereby degrading the quality of printed matters.

SUMMARY OF THE INVENTION

It is an object of the present invention to provide a plate exchange apparatus for a printing press, capable of easily and properly mounting a plate on a plate cylinder.

It is another object of the present invention to provide a plate exchange apparatus for a printing press, capable of improving the quality of printed matters.

In order to achieve the above objects of the present invention, there is provided a plate exchange apparatus for a printing press, comprising a plate guide member for guiding one end of a plate into plate gripper surfaces of a leading-side plate lockup device when the one end of the plate opposes the plate gripper surfaces of the leading-side plate lockup device, and inserting the plate into plate gripper surfaces of a trailing-side plate lockup device under pressure when the other end of the plate wound around a plate cylinder opposes the plate gripper surfaces of the trailing-side plate lockup device, and operating members for pressing the plate guide member against a circumferential surface of the plate cylinder until the other end of the plate is inserted under pressure after the one end of the plate is gripped.

DESCRIPTION OF THE PREFERRED EMBODIMENTS

Figure 1:
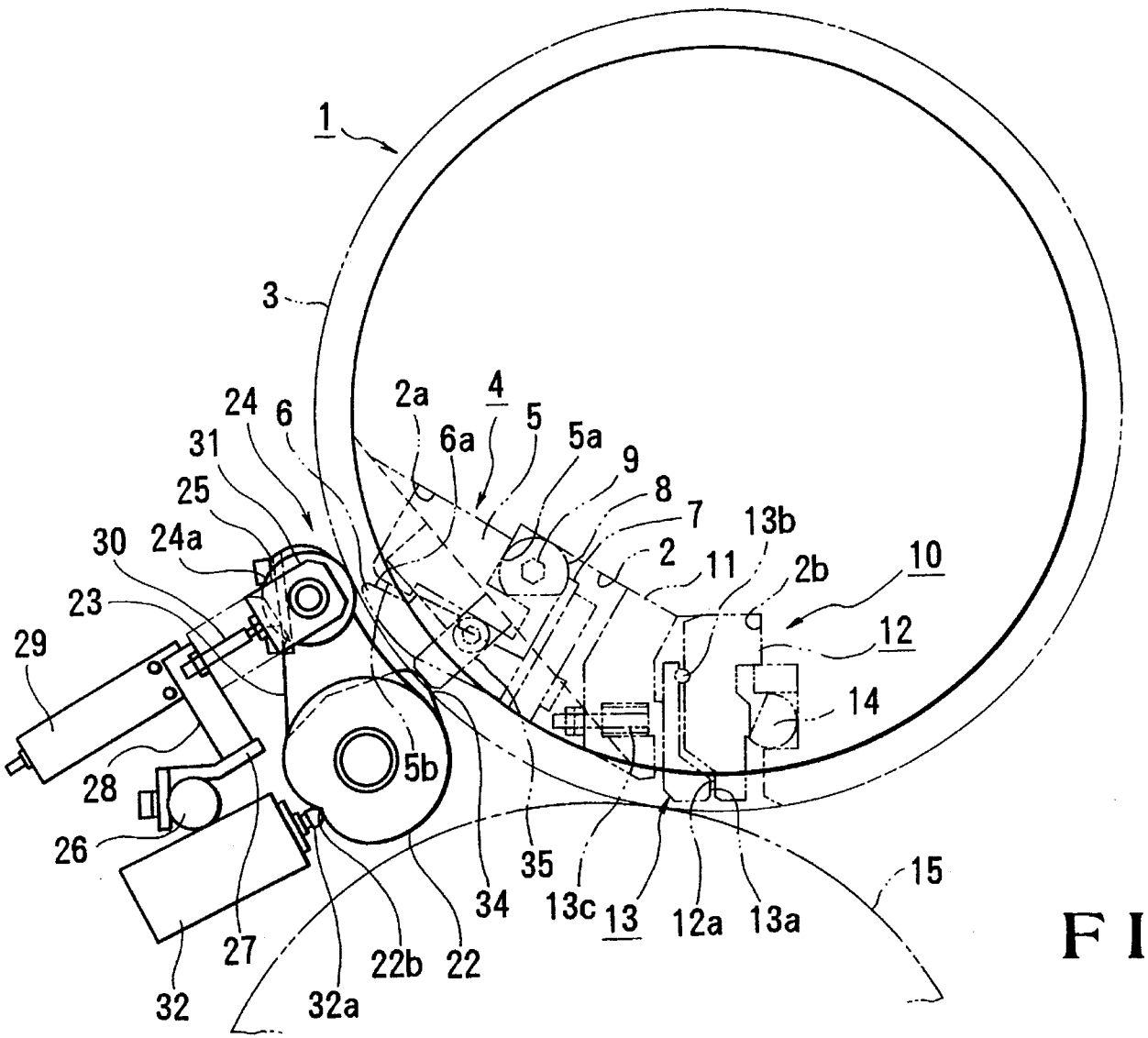
FIG. 1 is a front view showing the main part of a plate exchange apparatus in a state wherein a plate guide member opposes a leading-side plate lockup device.
Figure 2:
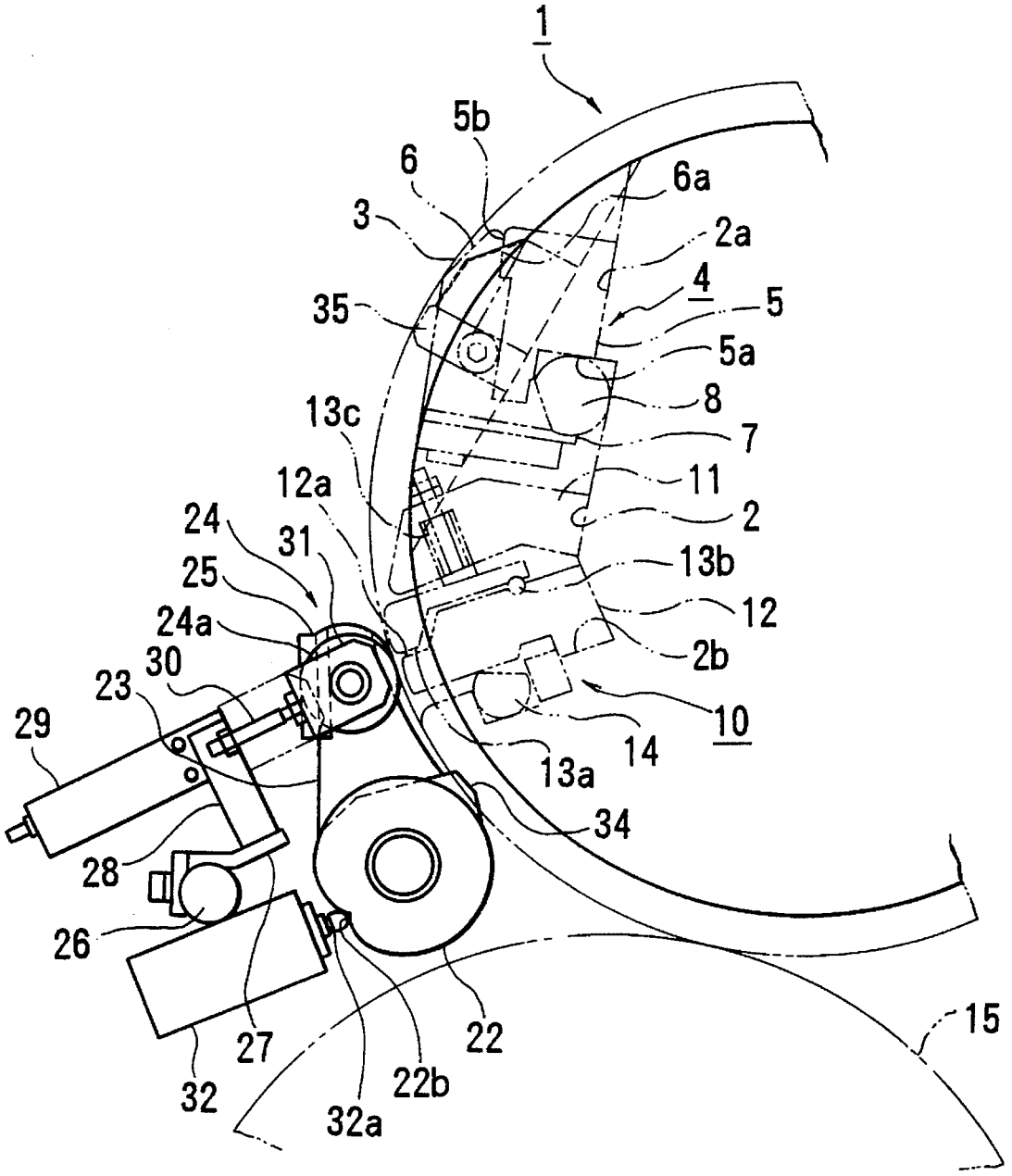
FIG. 2 is a front view showing the main part of the plate exchange apparatus in a state wherein the plate guide member opposes a trailing-side plate lockup device.
Figure 3:
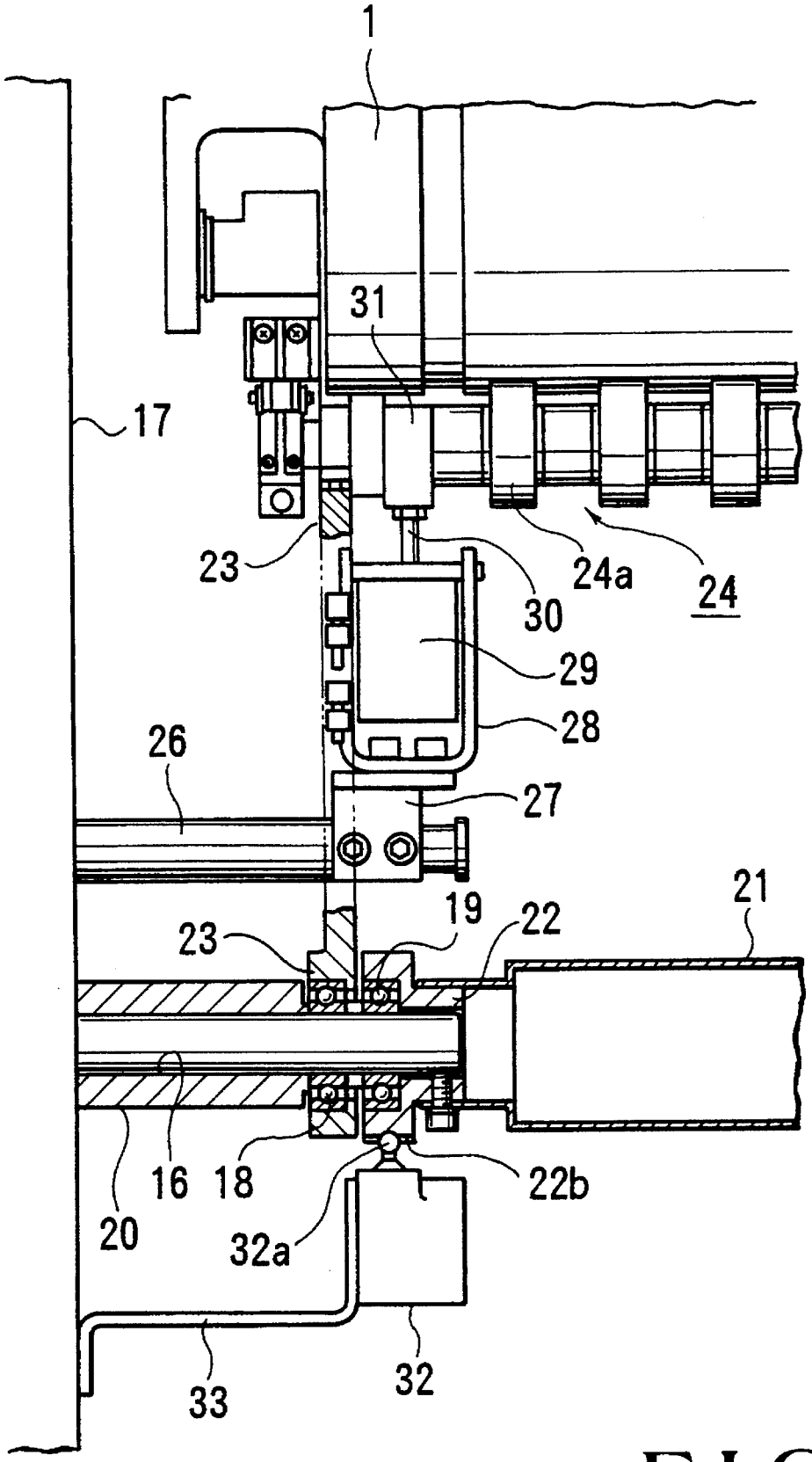
FIG. 3 is a developed side view of the plate exchange apparatus.
Figure 4:
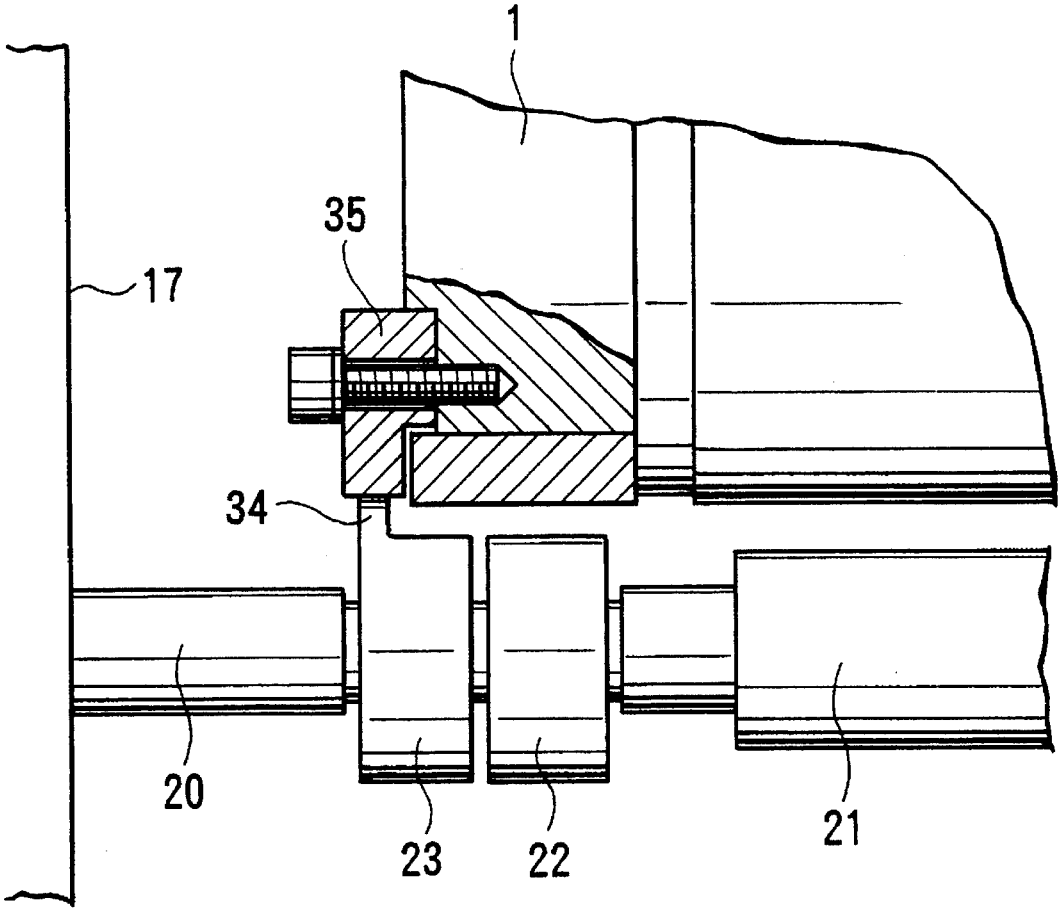
FIG. 4 is a side view showing the main part of the plate exchange apparatus.

FIGS. 1 to 4 show a plate exchange apparatus for a printing press according to an embodiment of the present invention, in which FIG. 1 shows the plate exchange apparatus and a plate cylinder in a state wherein a plate guide member opposes a leading-side plate lockup device, FIG. 2 shows the plate exchange apparatus and the plate cylinder in a state wherein the plate guide member opposes a trailing-side plate lockup device, and FIGS. 3 and 4 show the main part of the plate exchange apparatus.

Referring to FIGS. 1 and 3, a gap 2 is formed in the circumferential portion of a plate cylinder 1 throughout the entire length of the plate cylinder 1. Openings at both ends of this gap 2 are closed by disk-like bearers 3, respectively. A leading-side plate lockup device 4 comprises a plate lockup table 5 having an almost square section and extending along the axial direction of the plate cylinder 1. The leading-side plate lockup device 4 is bolted on a bottom surface 2*a* of the gap 2 and is movable along the bottom surface 2*a* of the gap 2 in the circumferential direction of the plate cylinder 1 by an adjustment unit (not shown). The plate lockup table 5 is also movable along the axial direction of the plate cylinder 1.

A plurality of gripper plates 6 divided in the axial direction and having the overall length almost corresponding to the overall length of the plate lockup table 5 are swingably supported by support bolts (not shown) mounted at a plurality of longitudinal positions of the plate lockup table 5. Hexagonal end portions of a cam shaft 9 having a plurality of cams 8 having a circumferential cam surface constituted by an arcuated portion and a linear portion extend through the bearers 3 and are pivotally supported between a notch 5*a* of the plate lockup table 5 and plates 7 fixed on the gripper plates 6 and extending along the axial direction of the plate cylinder 1. With this structure, a wrench is fitted on the hexagonal portion to manually pivot the cam shaft 9, or the cam shaft 9 is driven and pivoted by a drive unit, thereby opening/closing gripper surfaces 6*a* of the gripper plates 6 with respect to a gripper surface 5*b* of the plate lockup table 5.

A trailing-side plate lockup device 10 arranged in the gap 2 to be parallel with the leading-side plate lockup device 4 has an L-shaped spring seat bar 11 having almost the same length as that of the notch 5*a*, extending along the axial direction of the plate cylinder 1, and fixed on the bottom surface 2*a* of the gap 2. An almost rectangular plate lockup table 12 having almost the same length as that of the spring seat bar 11 extends along the axial direction of the plate cylinder 1 between the spring seat bar 11 and a gap wall surface 2*b* so as to be axially movable by adjustment bolts (not shown) interposed between the right bearer 3 and the plate lockup table 12 and between the left bearer 3 and the plate lockup table 12. Reference numeral 13 denotes an L-shaped gripper plate extending parallel between the spring seat bar 11 and the plate lockup table 12. The gripper plate 13 has almost the same length as that of the plate lockup table 12. The gripper plate 13 and the plate lockup table 12 are swingably coupled to a support shaft 13*b* having almost the same length as that of each of the gripper plate 13 and the plate lockup table 12.

Reference numeral 13*c* denotes a compression coil spring inserted between the spring seat bar 11 and the gripper plate 13 to bias them in opposite directions. A compression coil spring (not shown) is also interposed between the gripper plate 13 and the plate lockup table 12 to bias them in opposite directions. A cam shaft 14 having a plurality of cam portions each having a circumferential cam surface constituted by an arcuated portion and a linear portion is disposed in the recessed hole formed in the gap wall surface 2*b*, and hexagonal end portions of the cam shaft 14 extend outside through the bearers 3. When a wrench is fitted on the hexagonal end portion to manually pivot the cam shaft 14, or the cam shaft 14 is driven and pivoted by a drive unit (not shown), a gripper surface 13*a* of the gripper plate 13 is opened/closed with respect to a gripper surface 12*a* of the plate lockup table 12.

With this structure, when the leading end portion of the plate is gripped between the gripper surfaces 5*b* and 6*b* of the leading-side plate lockup device 4, and the plate cylinder 1 is rotated by almost one revolution to wind the plate on the circumferential surface of the plate cylinder 1, the trailing end portion of the plate which is bend at a right angle by a separate plate bending machine is gripped in the trailing-side plate lockup device 10, thereby mounting the plate on the circumferential surface of the plate cylinder 1. Reference numeral 15 denotes a blanket cylinder, brought into rolling contact with the plate cylinder 1, for transferring an image of the plate surface to a blanket surface.

Support end shafts 16 are supported and extend through right and left frames 17 near the contact portion between the plate cylinder 1 and the blanket cylinder 15. A pair of bearings 18 and 19 are fitted in each support end shaft 16 from the corresponding one of the right and left frames 17 through a corresponding spacer 20. A safety bar 21 is rotatably supported such that boss portions 22 of the safety bar 21 at both ends thereof are fixed on outer rings of the right and left bearings 19. Reference numerals 23 denote a pair of right and left roller arms. The proximal portions of the roller arms 23 are fixed on the outer rings of the bearings 18, so that the roller arms 23 are pivotally supported on the support end shafts 16, respectively. A plate press roller 24 serving as a plate guide member and having a plurality of large-diameter portions 24*a* is rotatably supported between free end portions of the right and left roller arms 23. Bearings for rotatably supporting both end portions of the plate press roller 24 are fixed in the bearing holes of the free end portions of the roller arms 23 by shaft holders 25.

On the other hand, brackets 27 are bolted on the extended end portions of support pins 26 extending on the right and left frames 17, respectively. U-shaped holders 28 are fixed on the brackets 27, and air cylinders 29 serving as actuating members are pivotally supported on the right and left holders 28, respectively. U-shaped portions 31 fixed on the operating ends of the piston rods 30 reciprocated by air pressures of the air cylinders 29 are fitted on the small-diameter portions of the plate press roller 24. The roller arms 23 are swung by reciprocating the piston rods 30 by air from the air cylinders 29. The plate press roller 24 is reciprocated in a radial direction of the plate cylinder 1 upon swingable movement of the roller arms 23, so that the plate mounted on the plate cylinder 1 is brought into contact with the circumferential surface of the plate 1 or separated therefrom.

Reference numeral 32 denotes a limit switch supported on the frame 17 through the bracket 33. An operating end 32*a* of the limit switch 32 is engaged in a recessed groove 22*b* formed in the boss portion 22 of the safety bar 21. Since the limit switch 32 causes the safety bar 21 to pivot when a foreign object such as a finger is almost caught between the plate cylinder 1 and the blanket cylinder 15. The limit switch 32 detects that the operating end 32*a* is disengaged from the recessed groove 22*b*, thereby stopping the printing press.

In addition, as shown in FIG. 4, cams 34 serving as regulating members extend on the boss portions of the roller arms 23. Stoppers 35 serving as regulating members for regulating movement of the leading-side plate lockup device 4 in the radial direction of the plate cylinder upon a positional coincidence between the cams 34 and the plate gripper surfaces 5*b* and 6*a* of the leading-side plate lockup device 4 are formed on an end face of the plate cylinder 1.

An operation of the plate exchange apparatus having the structure as described above will now be described. Assume that an old plate used is to be removed from the plate cylinder. In this case, as shown in FIG. 2, after the gripper surfaces 12*a* and 13*a* of the trailing-side plate lockup device 10 are câused to oppose the plate press roller 24, the cam shaft 14 is pivoted. The gripper surfaces 12*a* and 13*a* are opened to release the trailing end of the plate, and then the plate cylinder 1 is rotated clockwise in FIG. 2. The plate whose trailing end is released is guided and rewound by the plate press roller 24. The plate cylinder 1 is rotated by almost one revolution while the plate is being manually held. The plate cylinder 1 is then stopped. When the cam shaft 9 of the leading-side plate lockup device 4 is pivoted, the plate gripper surfaces 5*b* and 6*a* are opened to release the leading end of the plate, thereby removing the plate.

Assume that a new plate is to be mounted on the plate cylinder. In this case, the plate cylinder 1 is rotated counterclockwise in FIG. 1 so as to slightly return from the plate removal position, and rotation is stopped when the plate gripper surfaces 5*b* and 6*a* of the leading-side plate lockup device 4 oppose the plate press roller 24. At this time, the cams 34 oppose the stoppers 35. When the piston rods 30 of the air cylinders 29 are moved forward, the cams 34 abut against the stoppers 35 and are stopped. One end of the plate manually held is inserted between the open gripper surfaces 6*a* of the gripper plates 6 and the plate gripper surface 5*b* of the plate lockup device. In this case, since the circumferential surface of the plate press roller 24 and the circumferential surface of the plate cylinder 1 guide the plate to the gripper surfaces 5*b* and 6*a*, the plate can be easily and accurately inserted. In addition, movement of the plate press roller 24 in the radial direction of the plate cylinder 1 is regulated upon abutment between the cams 34 and the stoppers 35. Since the circumferential surface of the plate press roller 24 is regulated to locate on the same surface level as that of the plate gripper surfaces 5*b* and 6*a*, the plate guided by the plate press roller 24 is easily and accurately guided to the plate gripper surfaces 5*b* and 6*a*. An insertion amount of the plate does not become insufficiently small, or the plate can be prevented from undesirable bending and damage.

The cam shaft 9 is pivoted and the gripper plates are closed to grip the plate. Thereafter, when the plate cylinder 1 is rotated clockwise (FIG. 1) by almost one revolution, the plate is urged against the circumferential surface of the plate cylinder 1 by the plate press roller 24 and is wound in tight contact with the circumferential surface of the plate cylinder 1. As shown in FIG. 2, rotation of the plate cylinder 1 is stopped at a position where the plate exchange apparatus opposes the plate gripper surfaces 12*a* and 13*a* of the trailing-side plate lockup device 10. The trailing end portion bent at a right angle by a plate bending machine is inserted into the plate gripper surfaces 12*a* and 13*a* by the plate press roller 24 upon stopping the plate cylinder 1. When the cam shaft 14 is pivoted, the gripper surfaces 12*a* and 13*a* are closed to complete mounting of the plate.

In this embodiment, the plate guide member for guiding the leading end portion of the plate to the gripper surfaces is exemplified as the plate press roller 24. However, the plate guide member is not limited to this. For example, bosses of the roller arms 23 which pivotally support the plate press roller 24 may be arcuatedly extended to cause these extended portions to guide the plate. Alternatively, the plate press roller 24 may be replaced with a press plate or rubber pad to guide the plate.

In this embodiment, contact members for regulating movement of the plate guide member such as the plate press roller 24 in the radial direction of the plate cylinder are exemplified by the stoppers. However, the contact members are not limited to these. Cams 35 may be formed on the plate cylinder 1, and stoppers 35 may be formed on the roller arms 23. Alternatively, rollers may be used in place of the stoppers 35.

As can be apparent from the above description, according to the present invention, in the plate exchange apparatus for a sheet-fed press, the plate guide member is arranged to guide one end of the plate into plate gripper surfaces when the plate guide member opposes the plate gripper surfaces of the leading-side plate lockup device. When the plate guide member opposes the plate gripper surfaces of the trailing-side plate lockup device, the other end of the plate wound around the plate cylinder is inserted into the plate gripper surfaces under pressure. Therefore, the plate can be easily and accurately inserted in the plate gripper surfaces of the plate lockup devices. As a result, the quality of printed matters can be improved. In addition, the plate guide member is commonly used for plate insertion into the leading-side gripper surfaces and plate insertion into the trailing-side gripper surfaces. Therefore, the structure can be simplified, and a low-cost plate exchange apparatus an be provided.

The regulating members formed on the plate guide member and the plate cylinder and opposing to regulate movement of the plate guide member in the radial direction of the plate cylinder during plate gripping. Even if the stop phase of the plate cylinder is slightly deviated, the relative positional relationship between the plate guide member and the plate gripper surfaces of the leading-side plate lockup device is always kept constant. The plate guided by the plate guide member is properly guided to the leading-side gripper surfaces. Therefore, the quality of the printed matters can be improved, and operations can be facilitated because high-precision positioning of the plate cylinder stop position is not required.

What is claimed is:

1. A plate exchange apparatus for a printing press comprising: a plate press member for pressing a plate against a circumferential surface of a plate cylinder when said plate is wound around said plate cylinder, for guiding a leading end of said plate into plate gripper surfaces of a leading-side plate lockup device when said leading end of said plate opposes said plate gripper surfaces of said leading-side plate lockup device, and for inserting a trailing end of said plate into plate gripper surfaces of a trailing-side plate lockup device under pressure when said trailing end of said plate wound around said circumferential surface of said plate cylinder opposes said plate gripper surfaces of said trailing-side plate lockup device;

operating members coupled to said plate press member for pressing said plate press member against said circumferential surface of said plate cylinder until said trailing end of said plate is inserted under pressure after said leading end of said plate is gripped;

regulating members for regulating movement of said plate press member in a radial direction of said plate cylinder during plate gripping: and said regulating members including a first element arranged on said plate press member and a second element arranged on said plate cylinder, said first element and said second element opposing each other at the time of plate gripping.

2. An apparatus according to claim 1, wherein said plate press member is a plate press roller.

3. An apparatus according to claim 1, further comprising support members for swingably supporting said plate press member, and wherein said operating members coupled to said plate press member reciprocate said plate press member in a radial direction of said plate cylinder so as to press said plate press member against said circumferential surface of said plate cylinder.

4. An apparatus according to claim 1, further comprising support members for swingably supporting said plate press member, said regulating members comprising a cam formed on a boss portion of each of said support members and a stopper formed on an end face of said plate cylinder.

* * * * *